US007433642B2

(12) United States Patent
Higashi et al.

(10) Patent No.: US 7,433,642 B2
(45) Date of Patent: Oct. 7, 2008

(54) FIXING MEMBER, FIXING DEVICE AND IMAGE FORMING DEVICE WITH METAL LAYERS HAVING DIFFERENT SPECIFIC RESISTANCES

(75) Inventors: Taketoshi Higashi, Minamiashigara (JP); Shigeo Ohta, Minamiashigara (JP); Makoto Omata, Minamiashigara (JP); Masato Saitou, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 283 days.

(21) Appl. No.: 11/302,225

(22) Filed: Dec. 14, 2005

(65) Prior Publication Data

US 2006/0216078 A1 Sep. 28, 2006

(30) Foreign Application Priority Data

Mar. 23, 2005 (JP) ..... 2005-084971
Aug. 26, 2005 (JP) ..... 2005-245826

(51) Int. Cl.
*G03G 15/20* (2006.01)

(52) U.S. Cl. ..... 399/333

(58) Field of Classification Search ..... 399/330, 399/333; 219/216, 469–471
See application file for complete search history.

(56) References Cited

U.S. PATENT DOCUMENTS

| | | | | | |
|---|---|---|---|---|---|
| 4,791,275 | A | * | 12/1988 | Lee et al. | 219/469 |
| 4,796,046 | A | * | 1/1989 | Suzuki et al. | 399/333 |
| 5,035,950 | A | * | 7/1991 | Del Rosario | 219/216 |
| 5,089,856 | A | * | 2/1992 | Landa et al. | 219/469 |
| 5,666,624 | A | * | 9/1997 | Kanesawa et al. | 399/333 |
| 5,869,808 | A | * | 2/1999 | Hyllberg | 219/216 |
| 2004/0101335 | A1 | * | 5/2004 | Cho et al. | 399/330 |

* cited by examiner

*Primary Examiner*—Susan S Lee
(74) *Attorney, Agent, or Firm*—Oliff & Berridge, PLC

(57) ABSTRACT

The present invention provides a fixing member having a heat resistant resin layer, a metal layer having two or more layers, and a releasing layer, in this order from the inner peripheral side, wherein a specific resistance of the metal layer disposed at the outer peripheral side is larger than a specific resistance of the metal layer disposed at the inner peripheral side in the at least two metal layers, and a modulus of an internal stress of the metal layer disposed at the outer peripheral side is 5 kg/mm$^2$ or less. Further, a fixing device includes the fixing member, an electromagnetic induction heating device in which an electric field is applied to the fixing member, and a press member which press-contact the surface of a releasing layer of the fixing member. Furthermore, an image forming device having this fixing device is provided.

19 Claims, 3 Drawing Sheets

FIXING MEMBER, FIXING DEVICE AND IMAGE FORMING DEVICE WITH METAL LAYERS HAVING DIFFERENT SPECIFIC RESISTANCES

CROSS-REFERENCE TO RELATED APPLICATION

This application claims priority under 35 USC 119 from Japanese Patent Application Nos. 2005-84971 and 245826, the disclosures of which are incorporated by reference herein.

BACKGROUND OF THE INVENTION

1. Field of the Invention

The present invention relates to a fixing member for an electromagnetic induction heating for use in a device utilizing an electrophotographic system such as a copier, a printer or the like, to a fixing device using an electromagnetic induction heating method, and to an image forming device having the fixing device.

2. Description of the Related Art

In an image forming device such as a copier or a printer employing an electrophotographic system, the process of fixing a toner image formed on a recording material such as paper to make a permanent image has been conventionally called a "fixing process". Conventional fixing processes include methods of press fixing, oven fixing, and solvent fixing, however, the thermal press fixing method has been most commonly used. This is due to the fact that the thermal press fixing method can effectively transmit heat and fix the toner image more firmly than other methods, and furthermore, it is comparatively safe.

The thermal press fixing method is a method in which a recording material having an unfixed toner image formed thereon is passed through a nip formed by two heated rolls or belts. The unfixed toner, which is heated by the rolls or belts and brought into a fused state when passed through the nip, is pressed onto the recording material and fixed thereto by the nip pressure.

The roll or the belt of a fixing member has a releasing layer provided on its surface, so as to have good separability and to prevent the surface from being fixed to the fused toner. Further, the roll or the belt is heated by a heating member in order to transmit heat to the toner image.

A method of heating the roll or the belt from inside the roll with the radiant heat of a halogen heater, which is provided in the roll, has been conventionally used. With this method, it takes much time to heat the surface of the roll to be heated to the point where the toner image can be fixed, because the roll is heated from the inside. For this reason, when a user copies or prints something, it is necessary to wait for the printed item. Moreover, in order to make the waiting time as short as possible, the surface of the fixing roll is continuously heated at a high temperature during standby so as to maintain a temperature that is lower than the fixing temperature. However, this method increases power consumption due to the standby heating, hence, the method does not satisfy the recent demand to provide energy-efficient machines.

Thus, a fixing device using a thin film and a fixed heater is taught utilizing an energy-saving fixing method in certain patent documents such as Japanese Patent Application Laid-Open (JP-A) Nos. 63-313182 and 4-44074. There has also been a widely used method of using a thin film belt as the fixing member, and heating the fixing member with a planar-resistant heating body arranged in the thin belt. In this method, as compared with the method of heating the roll from within the center, it is possible to shorten the fixing time because the belt can be heated without a heat insulation air layer, and further, the method does not require heating the center of the roll.

However, in the method using the above-mentioned belt and planar-resistant heating body, the planar-resistant heating body itself possesses a heat capacity, and it is difficult to shorten the time necessary to reach a fixing temperature to the point that the user does not feel a waiting time. It is also difficult to make the temperature distribution of the planar-resistant heating body uniform in the axial direction. Therefore, considering the current state of the above-mentioned method, sufficient energy conservation and high-quality image forming have yet to be achieved.

Meanwhile, a method of heating a fixing member with an induction heating system has been studied in recent years (e.g., JP-A Nos. 11-352804, 2000-188177). The heating principle of an electromagnetic induction heat-fixing system will be explained below.

The electromagnetic induction heat-fixing system requires not only a heat-fixing member and a press member, which are conventionally used, but also a coil and a high-frequency power source. The coil is arranged at a position inside the heat-fixing member or outside and near the heat-fixing member, and is electrically connected to the high-frequency power source. A metal heating layer in either the shape of a roll or a belt can be used as the heat-fixing member, which is heated by electromagnetic induction.

A high-frequency alternating current is passed through the coil from the high-frequency power source. At this time, magnetic flux is generated in the coil in a direction perpendicular to a plane wound by the coil corresponding to the direction of the current. The magnetic flux crosses the metal heating layer of the heat-fixing member arranged near the coil, generating an eddy current that in turn generates a magnetic field in a direction canceling this magnetic flux generated in the metal heating layer. Since the resistance of the metal heating layer is determined by the type of metal and the thickness thereof, the electric energy of the generated eddy current is converted to thermal energy. A fixing device using heat generated in this manner is referred to as an electromagnetic induction heat-fixing device.

Since the surface of the fixing member is heated by the heating of the metal heating layer at this time, when the recording medium on which an unfixed toner image has been formed passes through the nip constituted by the fixing member and press member, the unfixed toner image is heated, pressurized, adhered, and fixed. In this method, the surface of the member to be heated can be heated effectively and thermally efficiently, making it possible to shorten the time necessary to reach a fixing temperature to an absolute minimum. As described above, the induction heat-fixing device includes a roll-type device and a belt-type device. In both types, by running a high-frequency current through the coil arranged near the member to be heated, an induced electromotive force is generated in the metal heating layer of the member, creating the eddy current that heats the member. In the roll-type device, a core metal can comprise the heating layer and be heated to a fixing temperature if an appropriate material is selected. The core metal material should be of a thickness capable of generating the eddy current with the coil, and heating the member with the eddy current.

However, in the case of a roll-type device, it is the core metal that is heated, so the fixing temperature can be reached in a shorter time. This is because unlike conventional heating systems, there is no air layer, however, the core metal needs to have a thickness of several millimeters because it must possess rigidity. As a result, the core metal of the heating layer inevitably has a large heat capacity, which in turn increases the time it takes to heat the core metal. Accordingly, it is impossible to sufficiently shorten the time it takes to reach the fixing temperature.

Methods of forming a belt-type induction heat-fixing member include a method of using the metal heating layer as a substrate, and a method of forming a metal heating layer on a heat-resistant resin substrate. In the case of a belt using a metal heating layer as the substrate, the thickness of the substrate of the metal heating layer needs to be dozens μm to 200 μm thick because the substrate needs to be strong to a certain extent. This increases the heat capacity of the substrate, which increases the amount of time necessary to heat the surface of the belt, though not to the same extent as the roll-type device.

Further, in order to form a nip with a press member and the belt, it is necessary to arrange a pressure applying member at a position opposite to the belt inside the belt. In many cases, a rubber pad is used as this pressure applying member because it forms the nip with the press member at a uniform pressure and ensures a nip width, however, this pad does not slide well against the metal substrate and is thus prone to intense deterioration.

Meanwhile, in the case of a belt using a substrate made of heat-resistant resin, engineering plastic having a heat resistance of 200° C. or more and having sufficient strength, such as polyimide or polyamide imide, is used. In this case, because the resin substrate ensures strength, the metal heating layer can be thinned as long as it can generate a sufficient amount of heat. Thus, in comparison with a belt having a metal substrate, it is possible to shorten the time it takes to reach the fixing temperature. Moreover, since the substrate is resin, it slides well against the pad inside the belt forming the nip.

The metal heating layer needs to be formed on the substrate in a uniform thickness. In certain cases, depending on the type of metal, the thickness of the layer can be decreased if the metal has low resistance, hence, it is possible to reduce the time it takes to reach the necessary fixing temperature. Generally speaking, metals such as copper, aluminum, and nickel are often used for the metal in the heating layer.

Using these metals, a thin metal film can be formed on the heat-resistant resin with methods such as plating, vapor disposition, and sputtering. As described above, there is an optimum thickness, depending on the type of metal used, and the thinner the thickness, the less rigid the belt itself becomes. A thinner belt is more flexible, making it easier to form a suitable nip, thereby forming a fixed image of better quality. In addition, the heat capacity of a metal heating layer with a thinner film can be decreased, providing the advantage of shortening the time required to reach the necessary fixing temperature. It is therefore necessary to select a metal that has low resistance and that can heat despite being thin, and to form the metal film as thinly and uniformly as possible.

However, in the current state of art, there are problems such that the durability of the thin metal heating layer is insufficient when the fixing belt in which the above-mentioned thin metal heating layer is formed on the resin substrate is used.

The thinner the film of the metal heating layer is, the less the heat capacity becomes, hence, the time required for the metal heating layer to reach the fixing temperature becomes shorter. Furthermore, the belt itself becomes more flexible which in turn improves the image quality, however, the strength of the metal heating layer decreases.

Further, the fixing member fuses toner unfixed toner images on the toner on the recording medium while applying pressure to the toner to firmly fix the toner to the recording medium. For this purpose, a press member (e.g., press roll, press pad, press belt and the like) disposed at a position opposed to the fixing belt is used such that a nip load is applied between the fixing belt and the press member. At this point, if the metal heating layer is thin, in some cases, the nip load necessary for fixing causes defects such as cracks or splits.

Moreover, even when the nip load is low, the heating layer is passed through the nip many times causing repeated bending stress, and defects can occur in the metal heating layer such as cracks or splits.

When such defects such as cracks and splits in the metal heating layer may be formed due to bending stress applied repeatedly thereto when the fixing belt passes through the nip, even if the nip load is low.

In such a fixing member, when defects such as cracks and splits are formed, the resistivity of the metal heating layer increases, or the heating property is deteriorated due to occurrence of an electrically insulation in the metal heating layer. Even if the formed cracks do not become splits, but rather groove-shaped defects, the thickness in those regions becomes locally thin, resulting in abnormal heating in the groove-shaped defects. A releasing layer coated on the surface burns or fuses, which drastically deteriorates the durability of the fixing member part due to the abnormal heating Thus, as disclosed in JP-A No. 2001-341231, a technology has been proposed in which flexibility was imparted to a substrate to thereby reduce the mechanical stress provided on the metal heating layer by using a polyimide resin as a heat resistant resin which constitutes the substrate, and by controlling the imidization rate of the polyimide resin when the substrate is formed.

However, the mechanical stress received by the metal heating layer due to the stress at the nip, is not fully relaxed by merely imparting the flexibility to the substrate, so that the deterioration of durability of the metal heating layer cannot sufficiently be avoided.

Further, in order to solve the problem of the deterioration of the metal heating layer, a method for disposing a protective layer on an outer periphery of a metal heating layer has been proposed (refer to JP-A No. 2004-70191). However, in this method, there are problems of adhesiveness between the metal heating layer and the protective layer, the heat capacity of the protective layer, and the production costs. Accordingly, in order solve the problem, it is considered that the protective layer is made of metal. However, when the protective layer is made of metal, there is a problem that the bending stress resistance is not sufficient, and this method cannot be used as such.

SUMMARY OF THE INVENTION

The present the invention was made in the light of the above problems. Specifically, an object of the invention is to provide a fixing member that the warming-up time is short and the deterioration of durability is suppressed, a fixing device using the fixing member and an image forming device using the fixing device.

A first aspect of the present invention is to provide a fixing member (hereinafter, may be referred to as a first fixing member of the invention) having a heat resistant resin layer, two or more metal layers, and a releasing layer, in this order from the inner peripheral side, wherein a specific resistance of the metal layer disposed at the outer peripheral side is larger than a specific resistance of the metal layer disposed at the inner peripheral side in the two or more metal layers, and a modulus of an internal stress of the metal layer disposed at the outer peripheral side is 5 kg/mm$^2$ or less.

A second aspect of the invention is to provide a fixing member of the first aspect, wherein a concentration of impure metal contained in the metal layer disposed at the outer peripheral side is 0.1% by weight or less.

A third aspect of the invention is to provide a fixing member of the first aspect of the invention, wherein the metal layer disposed at the inner peripheral side contains copper as the main component and the metal layer disposed at the outer peripheral side contains nickel as the main component.

A fourth aspect of the invention to provide a fixing member of the first aspect, wherein the metal layer disposed at the inner peripheral side and the metal layer disposed at the outer peripheral side are formed by electroplating.

A fifth aspect of the invention is to provide a fixing member of the first aspect, wherein the metal layer disposed at the outer peripheral side contains nickel as the main component, wherein the metal layer is formed by electroplating, by the use of a Watt bath in which a sulfur-containing organic compound is added.

A sixth aspect of the invention is to provide a fixing member of the first aspect, wherein the heat resistant resin has a polyimide as the main component.

A seventh aspect of the invention is to provide a fixing member of the first aspect, wherein the releasing layer is a fluorine resin as the main component.

An eighth aspect of the invention is to provide a fixing member of the first aspect, wherein the fixing member has an elastic layer between the metal layers and the releasing layer.

A ninth aspect of the invention is to provide a fixing member of the first aspect, wherein the fixing member is an endless belt.

A tenth aspect of the invention is to provide a fixing member of the first aspect, wherein the metal layers are heated by an electromagnetic induction device.

An eleventh aspect of the invention is to provide a fixing member including a heat resistant resin layer, two or more metal layers, and a releasing layer, in this order from the inner peripheral side, wherein a specific resistance of the metal layer disposed at the outer peripheral side is larger than a specific resistance of metal layer disposed at the inner peripheral side in the two or more metal layers, and a modulus of an internal stress of the metal layer disposed at the inner peripheral side is 5 kg/mm$^2$ or less.

A twelfth aspect of the invention is to provide a fixing member of the eleventh aspect, wherein the modulus of the internal stress of the metal layer disposed at the outer peripheral side is 5 kg/mm$^2$ or less.

A thirteenth aspect of the invention is to provide a fixing member of the eleventh aspect, wherein the modulus of the internal stress of a totality of the two or more metal layers laminated on the heat resistant resin layer is 5 kg/mm$^2$ or less.

A fourteenth aspect of the invention is to provide a fixing member of the eleventh aspect, wherein the concentration of impure metal contained in the metal layer disposed at the inner peripheral side is 0.1% by weight or less.

A fifteenth aspect of the invention is to provide a fixing member of the eleventh aspect, wherein the metal layer disposed at the inner peripheral side contains at least any one of gold, silver or copper as the main component(s).

A sixteenth aspect of the invention is to provide a fixing device comprising a fixing member having a heat resistant resin layer, two or more metal layers, and a releasing layer, in this order from the inner peripheral side, wherein the specific resistance of the metal layer disposed at the outer peripheral side is larger than the specific resistance of the metal layer disposed at the inner peripheral side in the two or more metal layers, and the modulus of the internal stress of the metal layer disposed at the outer peripheral side is 5 kg/mm$^2$ or less; an electromagnetic induction heating device for applying a magnetic field to the fixing member; and a press member which comes into contact with the surface of the releasing layer of the fixing member.

A seventeenth aspect of the invention is to provide a fixing device including a fixing member comprising a fixing member having a heat resistant resin layer, two or more metal layers, and a releasing layer, in this order from the inner peripheral side, wherein a specific resistance of the metal layer disposed at the outer peripheral side is larger than a specific resistance of the metal layer disposed at the inner peripheral side in the two or more metal layers, and a modulus of an internal stress of the metal layer disposed at the inner peripheral side is 5 kg/mm$^2$ or less; an electromagnetic induction heating device for applying a magnetic field to the fixing member; and a press member which comes into contact with the surface of the releasing layer of the fixing member.

An eighteenth aspect of the invention is to provide an image forming device comprising an image carrier, a charging unit for charging a surface of the image carrier, a latent image forming unit for forming a latent image on the charged surface of the image carrier, a developing unit for developing the latent image with a developing agent to form a toner image, a transfer means for transferring the toner image to an image receiving body and a fixing unit for heating and fixing the toner image onto a recording medium, wherein the fixing unit is the fixing member of the sixteenth aspect.

A nineteenth aspect of the invention is to provide an image forming device comprising an image carrier, a charging unit for charging a surface of the image carrier, a latent image forming unit for forming a latent image on the charged surface of the image carrier, a developing unit for developing the latent image with a developing agent to form a toner image, a transfer unit for transferring the toner image to an image receiving body and a fixing unit for heating and fixing the toner image onto a recording medium, wherein the fixing unit is the fixing member of the seventeenth aspect.

DETAILED DESCRIPTION OF THE INVENTION

<First Fixing Member>

Figure 1:
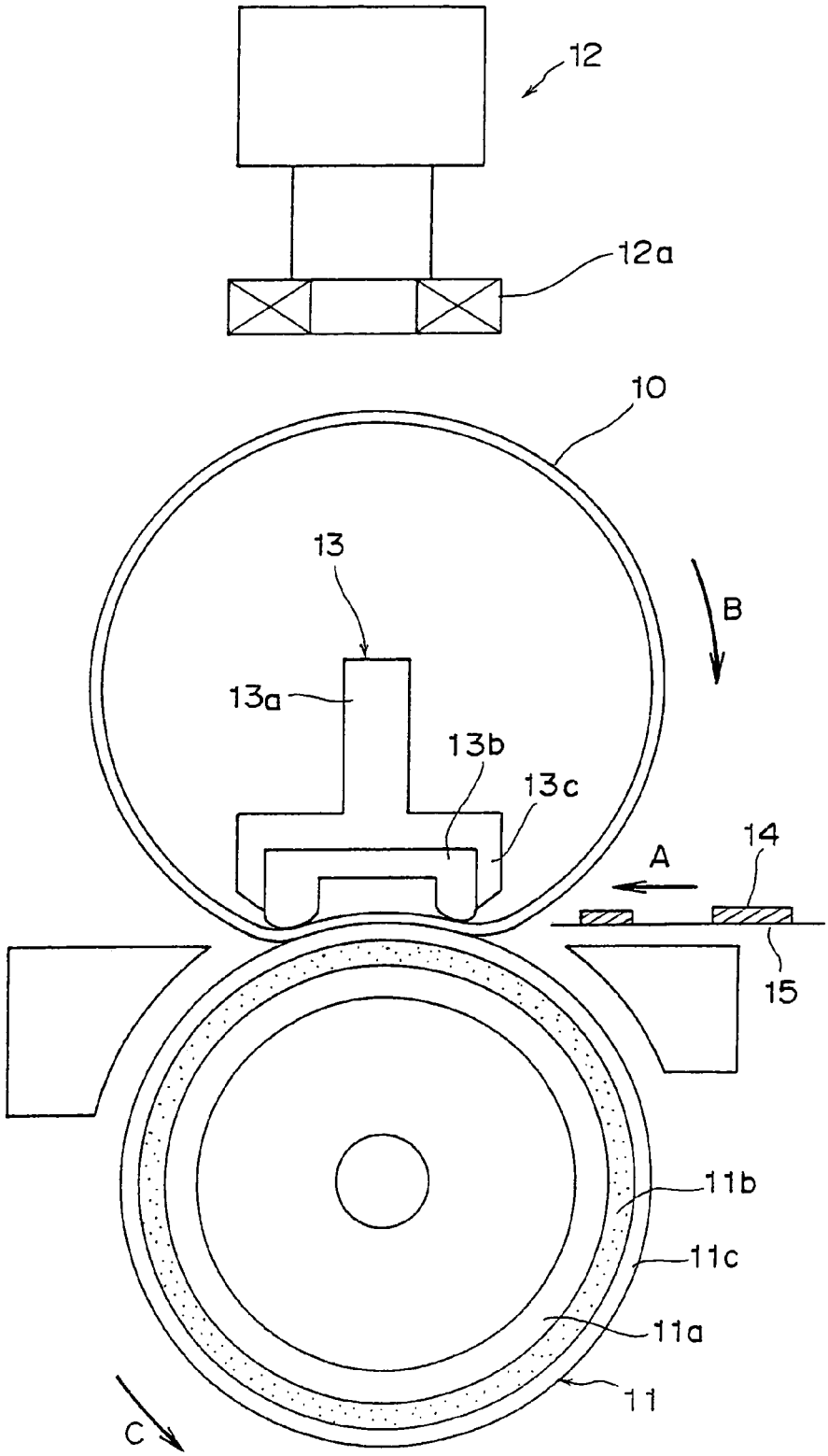
FIG. 1 is a schematic cross-sectional view showing an example of an electromagnetic induction heating and fixing device using a fixing member (fixing belt) of the invention.

A first fixing member of the present invention comprises a heat resistant resin layer, a metal layer having two or more layers, and a releasing layer. The specific resistance of the metal layer disposed at the outer peripheral side is larger than the specific resistance of the metal layer disposed at the inner peripheral side in the at least two metal layers, and the modulus of the internal stress of the metal layer disposed at the outer peripheral side is 5 kg/mm$^2$ or less.

In the fixing member of the invention, since the specific resistance of the metal layer disposed at the outer peripheral side is larger than the specific resistance of metal layer disposed at the inner peripheral side, and the modulus of the internal stress of the metal layer disposed at the outer peripheral side is 5 kg/mm$^2$ or less, an excellent durability against a repeated flexing stress. As a result, the metal layer disposed at the outer peripheral side effectively serves as a protective layer of the metal layer disposed at the inner peripheral side, deterioration due to fatigue of the metal layer disposed at the inner peripheral side can be prevented, and the reliability can be enhanced. Hereinafter, description will be made that as occasion demands, the metal layer disposed at the inner peripheral side is described as a metal heating layer and the metal layer disposed at the outer peripheral side is described as a protective layer.

As described above, the specific resistance of the metal layer disposed at the outer peripheral side is larger than the specific resistance of metal layer disposed at the inner peripheral side, however, it is required that the specific resistance ρA of the protective layer exceeds one-fold of the specific resistance ρB of the heating layer, it is preferable that it is 2-fold or more, more preferably 2.5-fold or more. In the case where the specific resistance ρA of the protective layer is less than one-fold of the specific resistance ρB of the heating layer, the warming up time becomes longer, and the effect of the invention may not exert. Moreover, in the case where it exceeds one-fold and is less than 2-fold, the warming up time can be securely shortened, however, the effect may be insufficient in comparison with the case where it exceeds 2-fold.

Moreover, the higher the specific resistance ρA of the protective layer than the specific resistance ρB of the heating layer, the more preferable. However, from the practical viewpoint that the range of choice of materials becomes narrower, the specific resistance ρA of the protective layer is preferably 20-fold or less of the specific resistance ρB of the heating layer. Herein, the value of the specific resistance can be measured by a method of utilizing 4 electric terminals/4 probes using a resistance meter, trade name: LORESTA GP MCP-T600 type manufactured by Dia Instruments, Co., Ltd. in accordance with JIS C 252 "conductor resistance of metal resistance material and volume resistivity test method". On the assumption that the specific resistance ρA of the protective layer is higher than the specific resistance ρB of the heating layer, the specific resistance ρA of the protective layer is preferably in the range of from 2 Ω·m to 30 Ω·m, more preferably in the range of from 3 Ω·ml to 30 Ω·m.

In a fixing member (for example, fixing belt) of the invention, a heat resistant resin layer (hereinafter, may be referred to as "substrate" or "heat resistant resin layer") comprising a heat resistant resin is provided on the surface of the side opposite to the side where a recording medium of the heating layer. Therefore, in comparison with a case where the heating layer also function as a substrate, the warming up time can be more shortened, since the loss of the heat generated in the heating layer toward the inner surface side (the surface side which is not brought into contact with the recording medium) of the fixing member is smaller. Moreover, since the sliding resistance with a pressure applying member such as a rubber pad provided inner surface of the fixing member can be suppressed, damage of the pressure applying member can be prevented so that the lifetime of the pressure applying member can be extended Moreover, in a fixing member of the invention, the protective layer is provided on the outer peripheral side of the heating layer. Therefore, the mechanical stress due to repeated distortion within a nip is relaxed by the protective layer when the fixing member (for example, fixing belt) rotates repeatedly, so that the occurrence of the mechanical defects such as cracks in the heating layer can be suppressed and the heating property can be stably maintained even if the fixing member is used over a long period of time.

In the case where such a protective layer is not provided, the both surfaces of the heating layer are strongly subjected to tension force or compression force, therefore, the mechanical defects such as cracks and the like are easily generated, and the electric characteristics and heating characteristics of the heating layer are deteriorated when the fixing member is used over a long period of time.

Such a protective layer functions to provide the required mechanical durability which the heating layer itself would provide under normal circumstances. Therefore, in the fixing member (for example, fixing belt) of the invention, the heating layer can be made thinner than a conventional heating layer. As a result, the heat capacity of the heating layer itself can be made smaller, and the warming up time made shorter.

Moreover, on the outer surface of a fixing member (at least surface with which the recording medium is brought into contact), a releasing layer formed of a resin material having a low surface energy such as fluorine resin is provided. Such a releasing layer has a lower heat conductivity and strength as compared with a metal material. However, in a fixing member of the invention, in which releasing layer is provided, the strength of the whole fixing member can be enhanced and the warming up time can be also shortened by replacing the thickness of this releasing layer with the thickness of a protective layer having an excellent heat conductivity and strength.

Further, it is necessary that the internal stress of the protective layer is small. In the case where the internal stress is large, at the time when it is flexed towards the side opposite to the side on which the stress exerts, the elongation limit of the material exceeds, and cracks or splits may be formed in the protective layer itself. It is required that the modulus of the internal stress is 5 kg/mm$^2$ or less, so as not to form cracks or splits.

Furthermore, the concentration of an impure metal contained in the protective layer is preferably 0.1% by weight. In the case where the impure metal exceeds 0.1% by weight, even if the internal stress is small, it becomes a fragile film, the resistance against the repeated flexing stress may not be enough.

Herein, the impure metal refers to a metal component except for nickel and a metal forming an alloy with nickel when nickel is a major component of the protective layer. In order to make the concentration of the impure metal 0.1% or less by weight, for example, when the protective layer is formed by a plating process, the concentration of the impure metal is set at 0.1% or less by weight in a plating liquid within a plating bath. The impure metal concentration in the plating liquid can be measured by an atomic absorption method, ICP or the like. The impure metal concentration in the protective layer can be measured by an atomic absorption method, ICP or the like, after dissolving it in a suitable solvent. Further, it may be measured by a fluorescent-X ray method.

The heating layer is preferably formed of copper as a major component, and the protective layer is preferably formed of nickel as a major component. The heating layer is formed of a metal selected from gold, silver, copper and aluminum from the viewpoint of the functionality. However, copper is more preferable from the viewpoint of cost and manufacturing easiness. The protective layer is preferably formed of nickel as a major component which can vapor-deposit on copper, and further, in light of functions and cost thereof.

Furthermore, in the case where the heating layer is made of copper as a main component, and the protective layer is made of nickel as a major component, the both layers can be formed by electroplating, and the manufacturing cost can be reduced.

-Constitution of Fixing Belt-

As a fixing member of the invention, for example, a fixing belt (endless belt) is exemplified. The constitution of the fixing belt will be explained below.

The structure of the fixing belt is not particularly limited as long as it has a constitution in which a heat resistant resin layer (substrate), a heating layer, a protective layer, and a releasing layer are provided in this order from the inner peripheral side to the outer peripheral side thereof. In order to obtain a higher color image quality and to achieve a higher black-and white image forming speed, an elastic layer may be provided between the protective layer and the releasing layer. Hereinafter, the respective layers which constitute the fixing belt will be explained in detail.

[Heat Resistant Resin Layer]

It is required that the physical properties of the heat resistant resin layer in the fixing belt are not deteriorated and a high strength thereof can be maintained, even when the heating layer provided adjacent to the heat resistant resin layer is heated during the fixation in the case where the fixing belt is rotatably entrained to be repeatedly conveyed, the fixing belt being mounted in a fixing device of an electromagnetic induction heating method, which will be described later. In order to achieve these purposes, the heat resistant resin layer is mainly formed of a heat resistant resin.

When a metal film is used in place of the heat resistant resin, the pressure applying member is damaged, an image can not be formed stably for a long period of time, because the slidability between the pressure applying member which is brought into contact with the inner surface of the fixing belt and the metal film.

Accordingly, as a layer which is brought into contact with the pressing member, the sliding resistance relative to the pressurizing member can be small and the life of the pressure applying member can be extended by providing a heat resistant resin layer composed of a heat resistant resin whose slidability is higher. Moreover, since the heat resistant resin has a thermal insulation effect, the heat generated in the heating layer can be efficiently used without radiation of heat to the pressure applying member.

A heat resistant resin which can be utilized includes highly heat resistant and highly strong resins, such as polyimides, aromatic polyamides, liquid crystal materials such as thermotropic liquid crystal polymers, Among these polymers, a heat resistant resin formed of a polyimide resin or a resin formed mainly of a polyimide resin as a major component (50% by weight or more) is preferably used. Moreover, a filler having a thermal insulation effect may be added to the heat resistant resin the heat resistant resin may be foamed.

The thickness of a heat resistant resin layer is preferably in the range from 10 to 100 μm, more preferably in the range from 30 to 80 μm from the viewpoint that both of the rigidity and flexibility which enable the belt to be rotatably entrained to be repeatedly conveyed, for a long period of time. When the thickness of the heat resistant resin layer is less than 10 μm, the rigidity is low, so that wrinkles mar be formed, or cracks at the both side edges during repeated conveyance in the rotatably entrained state of the belt. On the contrary, if the thickness exceeds 100 μm, the flexibility may not be maintained, or the warming up time may be longer due to an increase in heat capacity. Furthermore, the degree of the surface roughness of the heat resistant resin layer may be roughened in the range from 0.1 Ra to 5 Ra for the purpose of enhancing the adhesiveness of the heat resistant layer with the metal layer.

[Heating Layer]

In a fixing belt of the invention, the heating layer is a layer which is heated by an eddy current by a magnetic field generated from a coil in an electromagnetic induction heating fixing device. As such a metal, for example, nickel, iron, copper, gold, silver, aluminum, chromium, tin, zinc and the like, singly or in the form of an alloy of two or more kinds of these metals can be selected. Among these metals, since copper, gold and silver have a low specific resistance, copper, gold, silver and the alloys thereof are preferred, and it is particularly preferable that copper or a copper alloy containing copper as a major component (the "major component" means that the content of the component is 50% or more by weight, and similarly in the case of a protective layer).

Particularly, in the second fixing member of the invention, it is preferable that a heating layer itself, which will be described later, has a sufficient mechanical resistant stress property, so that it is essential that the modulus of the internal stress is 5 kg/mm$^2$ or less, preferably 2 kg/mm$^2$ or less, and more preferably 1 kg/mm$^2$ or less. Since the smaller the internal stress is, the higher the mechanical resistant stress property, it is preferable that the internal stress is 0. However, the control of the internal stress becomes difficult.

Therefore, it is sufficient that the heating layer has a practically sufficient resistance, and if the internal stress is 5 kg/mm$^2$ or less, the resistance to the mechanical stress is practically sufficient. In the case where the internal stress is large, the reliability becomes low, even if a protective layer, which will be described later, is provided.

Moreover, in the second fixing member of the invention, the concentration of an impure metal contained in a heating layer is preferably 0.1% by weight or less, more preferably 0.05% by weight or less, and still more preferably 0.02% by weight or less. If the impure metal is 0.1% by weight or more, the heating layer tends to be fragile, and the reliability may be reduced.

Moreover, in the second fixing member of the invention, a heating layer is preferably formed by an electroplating. When the second fixing member is formed by an electroplating method and the internal stress is made in a desired range, for example, it is preferable that the concentration of impurities is brought to 0.1% by weight or less in a plating liquid, or the current density is adjusted to a preferable range from 0.1 to 10 A/dm$^2$, or a leveling agent or stress buffering member is added. These conditions are preferably used in combination.

The thickness of heating layer is preferably thinner, from the viewpoint of heat capacity. However, if the thickness is less than 3 μm, an eddy current may not be sufficiently generated due to a high value of resistance thereof, resulting in insufficient heating, and thus the warming up time may be longer, or the heating cannot be conducted to the temperature necessary for fixation. Moreover, if the thickness of the heating layer exceeds 20 μm, a sufficient heating is obtained, but the warming up time may be longer due to an increase in the heat capacity of the heating layer. Therefore, the thickness of the heating layer is preferably in the range from 3 to 20 μm, more preferably in the range from 5 to 15 μm.

A metal layer formed between a substrate and a heating layer by an electroless plating method. Conventionally, in a laminated film of a flexible substrate such as polyimide or the like and copper, a in many cases, first metal layer is formed by vapor deposition, sputtering or the like by means of a PVD method using a vacuum apparatus, in order to form a highly adhesive layer. However, in a layer forming method using a vacuum apparatus, particularly, the cost may be raised due to the necessity of a batch process for a base body having in a cylindrical shape such as a fixing belt. Accordingly, by utilizing a base body composed of a heat resistant resin and the like to which roughening treatment is carried out in the invention instead of achieving a required adhesiveness by the use of a PVD method, a sufficient adhesiveness can be obtained even if a metal layer having a lower adhesiveness formed by a catalyst reaction using an electroless plating, so the a low cost can be realized.

Moreover, if the metal layer formed by an electroless plating is formed of at least one of nickel, copper and chromium, the metal layer can be used as an electrode for preparing a heating layer by electroplating.

[Protective Layer]

In order to protect a heating layer by relaxing a mechanical stress applied to the heating layer and suppressing defects such as cracks, the heating layer itself preferably has a sufficient mechanical resistant stress property. For this reason, it is essential that the modulus of the internal stress is 5 kg/mm$^2$ or less, preferably 2 kg/mm$^2$ or less, and more preferably 1 kg/mm$^2$ or less. It is preferable that the modulus of the internal stress is brought to 0, since the mechanical stress property of the protective layer itself increases with decreasing internal stress. However, the control of the modulus of the internal stress becomes difficult. Accordingly, it will suffice that the protective layer has a practical resistance, and if the modulus of the internal stress is 5 kg/mm$^2$ or less, the resistance to a mechanical stress is sufficient in practice.

The concentration of an impure metal contained in the protective layer is preferably 0.1% by weight or less, more preferably 0.05% by weight or less, and still more preferably 0.02% by weight or less. If the impure metal is 0.1% by weight or more, the protective layer tends to be fragile, and the reliability may be reduced.

Moreover, the protective layer preferably has a thickness which can assure a sufficient strength for protecting the heating layer by suppressing occurrence of defects such as cracks. For this reason, the thickness of the protective layer is preferably at least 1 μm or more, more preferably 2 μm or more.

In the case where the thickness of the protecting layer is less than 1 μm, the heating layer cannot sufficiently be protected, the cracks or the like are generated in the heating layer, and the problems such as reduction in heating property may occur.

Therefore, from the viewpoint of securing the strength of the protective layer, it is preferable that the thickness of the protective layer is larger, however, the heat capacity of the protective layer increases with an increase in the thickness thereof, and as a result, the warming up time may be prolonged. Accordingly, the layer thickness of the protective layer is preferably 10 μm or less, more preferably 7 μm or less.

Material for constituting the protective layer is preferably, nickel, chromium, tin, zinc or an alloy containing the metal as a major component. Moreover, when the heating layer is formed of copper or an alloy containing copper as a major component, the protective layer is preferably formed of nickel or an alloy containing nickel as a major component. As a method for preparing the protective layer in this case, an electroplating is preferably used. It is possible that a protective layer having an excellent adhesive property and uniform layer thickness can be made at a low cost by utilizing the electroplating. There is also an advantage that an impurity can be easily removed by performing plating at a low current when the protective layer is manufactured by the electroplating, As described above, it is preferable that the metal layers including the protective layer is preferably formed by an electroplating. When the protective layer is formed by an electroplating method and the internal stress is made in a desired range, for example, it is preferable that the concentration of impurities is brought to 0.1% by weight or less in a plating liquid, or the current density is adjusted to a preferable range from 0.1 to 10 A/dm$^2$, or a leveling agent or stress buffering member is added. These conditions are preferably used in combination.

As an electroplating method for nickel, Watt bath has been known. However, the tensile stress of the nickel layer prepared by the Watt bath is large, therefore, the layer cannot be used as a protective layer as such. Accordingly, it is preferable that a stress reducing member which is represented by an organic compound containing sulfur is added. Examples of the stress reducing member include saccharine, paratoluene sulfamide, benzene disulfonic acid, sodium 1,3,6-naphthalene trisulfonate. A protective layer formed by adding the stress reducing member in an appropriate amount to reduce reducing the internal stress can be used. The amount of the stress reducing member to be added is preferably in the range from 3 to 40 mg/L.

In addition to the above, a method such as nickel sulfamate bath and nickel sulfamate high speed bath has also been known. Wen the protective layer is manufactured by this method, the value of the internal stress of the layer largely varies with the temperature and current density. Therefore, it is important to perform the plating under the conditions that the internal stress becomes small so as to meet the requirements for use as a protective layer. Although there is a problem that the control of the liquid of the nickel sulfamate bath or nickel sulfamate high speed bath is difficult, a sulfur component is not contained in the nickel layer, and there is an advantage that the layer has an excellent thermal resistant property.

[Releasing Layer]

A fixing belt of the invention has a releasing layer containing a low surface energy material such as fluorine-based compound as a major component for the purpose of preventing the surface of the side of the belt brought into contact with the recording medium from adhering with an unfixed toner image in a fused state during fixation.

Fluorine-based compounds used in a releasing layer, include, for example, fluorine rubber, fluorine resin such as polytetrafluoroethylene (hereinafter, referred to as "PTFE"), perfluoroalkyl vinylether copolymer (hereinafter, referred to as "PFA"), tetrafluoroethylene/hexafluoropropylene copolymer (hereinafter, referred to as "FEP") and the like, but it is not limited thereto.

Moreover, the thickness of the releasing layer is preferably in the range from 10 to 100 μm, more preferably in the range from 20 to 50 μm. If the thickness of the releasing layer is less than 10 μm, the releasing layer may be worn out due to repeated abrasions by the edges of the recording medium. On the other hand, the thickness of the releasing layer exceeds 100 μm, the flexibility of the surface becomes low, and as a result, the pressurizing force is applied onto the toner so that the graininess of the fixed image may be deteriorated. Furthermore, since the heat capacity of the releasing layer becomes larger, the warming up time may be longer.

[Elastic Layer]

The fixing belt of the invention may further have an elastic layer provided between the protective layer and the releasing layer. Particularly, in the case where a color image is formed, it is preferable that the elastic layer is provided.

When a color image is formed, it is necessary that a color image is fixed in a state where four color toner images formed of black, magenta, yellow and cyan colors are layered on the recording medium. Namely, a sharp color image by applying a certain quantity, or more of heat uniformly to the layered four color toner images can be obtained such that the four colors are fully mixedly fused. However, if a fixing belt which does not have an elastic layer is used, the layered toner images may be pressurized and smashed. Since a sufficient heat is not applied to the color toner image close to the recording medium (namely, the toner image in the lower layer in the layered images), the color image forming property obtained by fixation may be deteriorated.

Moreover, even in the case where a black and white image is formed, it is preferable that in particular, in order to satisfy the requirements for a high speed processing, an elastic layer is provided. When the elastic layer is provided, the elastic layer is distorted within the nip region and a sufficient nip width can be obtained even if a low load is applied, and the heat can be transferred to the toner image, and the fixation is possible even at a high speed operation.

As materials constituting an elastic layer, known elastic materials can be used, and the elastic materials, for example, include a heat resistant rubber such as silicone rubber and fluorine rubber. As such a heat resistant rubber, for example, liquid silicone rubber SE6744 manufactured by Dow Corning Toray Silicon, Co., Ltd. and Viton B-202 manufactured by DuPont Dow Elastomers, Co., Ltd. and the like are exemplified.

-Method for Manufacturing Fixing Belt-

As an embodiment of the fixing member of the invention, a fixing belt is exemplified and the method for manufacturing the fixing belt will be explained below. As the method for manufacturing the belt, known methods can be utilized. The thickness of a heating layer and a protective layer is thin so that handling of these layers is difficult singly, and therefore, a heating layer and a releasing layer are formed in this order on a heat resistant resin layer. Further, an elastic layer and the like can be appropriately formed, if necessary.

When "a releasing layer" or "an elastic layer and a releasing layer" is/are formed by a coating method, it is preferable that the pretreatment with an appropriate primer material is performed onto the surface of the protective layer or the surface of the elastic layer prior to the formation by coating of these layers, if necessary. The adhesive property between the respective layers can be enhanced by performing such a pretreatment.

It should be noted that in the case where "a releasing layer" or "an elastic layer and a releasing layer" is/are laminated and formed on the protective layer by a coating method, the releasing layer and the elastic layer are formed via a process that a coated film which has been coated and formed is treated by heating.

When the coated layer is subjected to a heat treatment, in the case where the protective layer is formed of a metal susceptible to oxidation, the surface of the protective layer may be oxidized and the adhesive property with the layer formed on the surface of the protective layer may be lowered. In such a case, it is preferable that heating treatment of the coated layer is carried out under an inert gas atmosphere (nitrogen gas, argon gas or the like).

<Second Fixing Member>

A second fixing member of the invention comprises a heat resistant resin layer, a metal layer formed of two or more layers, and a releasing layer, which are formed in this order from the inner peripheral side, and the specific resistance of the metal layer disposed at the outer peripheral side is larger than the specific resistance of metal layer disposed at the inner peripheral side of the at least two metal layers, and the modulus of an internal stress of the metal layer disposed at the inner peripheral side is 5 $kg/mm^2$ or less.

The second fixing member of the invention, has an excellent resistance to the repeated flexing stress, since the specific resistance of the metal layer disposed at the outer peripheral side is larger than the specific resistance of metal layer disposed at the inner peripheral side, and the modulus of the internal stress of the metal layer disposed at the inner peripheral side is 5 $kg/mm^2$ or less.

The second fixing member of the invention is the same as the first fixing member, as described before, of invention except that it is essential that the modulus of the internal stress of the metal layer disposed at the inner peripheral side is 5 $kg/mm^2$ or less and the second fixing member optionally includes the following embodiments.

Furthermore, the concentration of an impure metal contained in the heating layer is preferably 0.1% by weight. In the case where the impure metal exceeds 0.1% by weight, even if the internal stress is small, it becomes fragile, the resistance against the repeated flexing stress may not be enough.

Here, an impure metal refers to a metal component except for copper and a metal forming an alloy with copper when copper is a major component of the heating layer. In order to make the concentration of the impure metal 0.1% by weight or less, for example, when the heating layer is formed by a plating method, the concentration of the impure metal is set 0.1% or less by weight in a plating liquid within a plating bath. The impure metal concentration in the plating liquid can be measured by an atomic absorption, ICP or the like. The impure metal concentration in the protective layer can be measured by measuring it using atomic absorption, ICP or the after dissolving the protective layer in a suitable solvent Further, it may be measured by a fluorescent-X ray method.

The impurities in a plating liquid can be removed by performing the plating operation for about 10 to 30 hours at the current value in the range from about 0.2 to 0.5 $A/dm^2$.

In a fixing member (for example, fixing belt) of the invention, a heat resistant resin layer (hereinafter, may be referred to as "substrate" or "heat resistant resin layer") comprising a heat resistant resin is provided on the surface of the side opposite to the side where a recording medium of the heating layer. Therefore, in comparison with a case where the heating layer also function as a substrate, the warming up time can be more shortened, since the loss of the heat generated in the heating layer toward the inner surface side (the surface side which is not brought into contact with the recording medium) of the fixing member is smaller. Moreover, since the sliding resistance with a pressure applying member such as a rubber pad provided inner surface of the fixing member can be suppressed, damage of the pressure applying member can be prevented so that the lifetime of the fixing member can be extended Furthermore, in a fixing member of the invention, a protective layer is provided on the outer peripheral side of the heating layer. It is possible that when a belt is bent, a neutral axis is adjusted in the vicinity of the center of the heating layer by providing the protective layer. The mechanical stress due repeated distortion within a nip is lowered by allowing the neutral axis to be in the vicinity of the center of the heating layer when the fixing member (for example, a fixing belt) rotates repeatedly. Namely, occurrence of the mechanical defects such as cracks and the like in the heating layer is suppressed and the heating property can be stably maintained even if the fixing member is used over a long period of time.

The neutral axis of the member having a belt shape is calculated by the following equation. Upon selecting the surface of this member having a belt shape as a reference surface, the distance in the thickness direction of being represented by "y", the cross-sectional area of the i-th layer from the reference surface being represented by "$A_i$", the width of this layer is represented by "$b_i$", the elastic coefficient being represented by "$E_i$", the distance "$y_o$" from the surface of the member having a belt shape to the neutral axis is defined by the following equation (Equation 1).

$$y_0 = \sum\left(E_i \int_{Ai} y\,dA_i\right) \Big/ \sum E_i A_i \qquad \text{[Equation 1]}$$

Here, when a unit width (b=1) is used as $b_i$, $dA_i = dy_I$ is obtained, and the distance $y_0$ from the surface of the member having a belt shape to the neutral axis is represented by the following equation (Equation 2).

$$y_0 = \sum\left(E_i \int_{Ai} y\,dy_i\right) \Big/ \sum E_i y_i \qquad \text{[Equation 2]}$$

It is preferable that the position of the neutral axis is in the range of from ⅓ to ⅔ from the upper surface of the heating layer. when the neutral axis is not positioned in the vicinity of the center at the time when the fixing belt is bent, cracks are formed in the heating layer in a short period of time and the heating property is deteriorated due to the mechanical stress caused by distortion repeatedly in the nip when the fixing belt is repeatedly rotated.

In the case where such a protective layer is not provided, since the heating layer is strongly subjected to a tensile force or compression force on the both surfaces of the heating layer, mechanical defects such as cracks is easily generated, and it is used for a long period, the electric property or the heating property of the heating layer is deteriorated.

Such a protective layer functions to retain the mechanical durability which the heating layer itself should have inherently. Therefore, the fixing member (for example, fixing belt) of the invention, the heating layer can be made thinner than a conventional heating layer. As a result, the heat capacity of the heating layer itself can be smaller, and the warming up time can be shorter. On the outer surface of a fixing member (at least surface with which the recording medium is brought into contact), a releasing layer formed of a resin material having a low surface energy such as fluorine resin is provided. Such a releasing layer has a lower heat conductivity and strength as compared with a metal material.

However, in a fixing member of the invention, in which releasing layer is provided, the strength of the whole fixing member can be enhanced and the warming up time can be also shortened by replacing the thickness of this releasing layer with the thickness of a protective layer having an excellent heat conductivity and strength.

Further, it is necessary that the internal stress of the protective layer is small. In the case where the internal stress is large, at the time when it is flexed towards the side opposite to the side on which the stress exerts, the elongation limit of the material exceeds, and cracks or splits may be formed in the protective layer itself. It is required that the modulus of the internal stress is 5 kg/mm$^2$ or less, so as not to form cracks or splits Furthermore, the concentration of an impure metal contained in the protective layer is preferably 0.1% by weight. In the case where the impure metal exceeds 0.1% by weight, even if the internal stress is small, it becomes a fragile film, the resistance against the repeated flexing stress may not be enough.

Here, the impure metal refers to a metal component except for nickel and a metal forming an alloy with nickel when nickel is a major component of the protective layer. In order to make the concentration of the impure metal 0.1% or less by weight, for example, when the protective layer is formed by a plating process, the concentration of the impure metal is set at 0.1% or less by weight in a plating liquid within a plating bath. The impure metal concentration in the plating liquid can be measured by an atomic absorption method, ICP or the like. The impure metal concentration in the protective layer can be measured by an atomic absorption method, ICP or the like, after dissolving it in a suitable solvent. Further, it may be measured by a fluorescent-X ray method The heating layer is preferably formed of at least one of gold, silver and copper as a major component, and the protective layer is preferably formed of nickel as a major component. The heating layer is formed of a metal selected from gold, silver, copper and aluminum from the viewpoint of the functionality. However, gold, silver or copper is more preferably selected because a thin layer can be formed by using these metals. Further, copper is most preferable from the viewpoint of cost and manufacturing easiness. The protective layer is preferably formed of nickel as a major component which can vapor-deposit on copper, and furthermore, in light of functions and cost thereof.

Furthermore, in the case where the heating layer is made of one of gold, silver and copper as a main component, and the protective layer is made of nickel as a major component, the both layers can be formed by electroplating, and the manufacturing cost can be reduced.

<Fixing Device and Image Forming Device>

Next, a fixing device of the invention using a fixing member (fixing belt) of the invention and an image forming device of the invention using this fixing device will be explained below.

-Fixing Device-

A fixing member (fixing belt) of the invention can be used for a fixing belt of a fixing device in which a known electromagnetic induction heating method (electromagnetic induction heating fixing device) is used. In the fixing device using a fixing member (fixing belt) of the invention, the heating property of the fixing belt is not deteriorated, even if the belt is used over a long period of time, so that a high image quality can stably obtained. Further, the fixing device consumes a low stand-by power which leads to be energy-saving.

The fixing device of the invention preferably has the following constitution. Namely, it is preferable that a fixing device of the invention has a constitution comprising at least a fixing belt of the invention having a heating layer which generates heat due to an eddy current generated by applying a magnetic field to the heating layer, a press member which forms a nip by bringing into contact with the fixing belt and rotates, a pressure applying member for pressing the surface opposite to the side on which the press member of the fixing belt is provided, and a magnetic exciting coil which applies a magnetic field to the heating layer by passing an alternate current.

The fixation in such a fixing device is performed by inserting the recording medium on which an unfixed toner image has been formed into the nip formed between the fixing belt and the press member so that the unfixed toner image is brought into contact with the fixing belt being heated. When the recording medium passes through the nip, the unfixed toner image is pressed in a fused state and is fixed on the surface of the recording medium.

Next, an embodiment of the fixing device will be explained with reference to the drawings.

FIG. 1 is a schematic cross-sectional drawing showing an example of an electromagnetic induction heating fixing device using a fixing belt of the invention. In FIG. 1, the reference numeral 10 denotes a fixing belt of the invention. A press member 11 (in this drawing, press roll) is disposed so as to be brought into contact with the fixing belt 10, and the nip is formed between the fixing belt 10 and the press member 11. The press member 11 has an elastic body layer 11*b* made of silicone rubber or the like formed on a base member 11*a*, and a releasing layer 11*c* made of fluorine based compound formed on the elastic body 11*b*.

A pressure applying member 13 for pressing the inner surface of the fixing belt 10 and for locally raising the nip pressure is provided at the position where the pressure applying member 13 is opposed to the press member 11 inside the fixing belt 10. The pressure applying member 13 includes a nip head 13*b* which is brought into contact with the inner surface of the fixing belt 10 and presses the nip, a nip pad 13*c* formed of silicone rubber and the like for holding the nip head 13*b*, and a supporting body 13*a* for supporting the nip pad 13*c*.

An electromagnetic induction heating device 12 having an electromagnetic induction coil (magnetic exciting coil) 12*a* therein is provided at the position opposite to the press member 11 with respect to the fixing belt 10. A magnetic field generated by passing an alternate current in the electromagnetic induction coil of the electromagnetic induction heating device 12 is changed by an exciting circuit so that an eddy current is generated in the heating layer of the fixing belt 10. This eddy current is converted into heat (Joule heat) by an electric resistance of the heating layer, resulting in the generation of heat of the surface of the fixing belt 10. The electromagnetic induction heating device 12 may be placed at the upstream side of the rotating direction B with respect to the nip section of the fixing belt 10.

Next, the fixation by the use of the electromagnetic induction heating fixing device shown in FIG. 1 will be explained below. First, the press member 111 rotates in the direction of the arrow C by a drive device (not shown), and the fixing belt 10 is also driven and rotated with the rotation of the press member 11 in the direction of the arrow B. Herein, a recording medium 15 on which unfixed toner images 14 are formed is inserted into the nip section of the fixing device in the direction of the arrow A. At this time, the unfixed toner images 14 are pressed onto the surface of the recording medium in a fused state, and are fixed on the surface of the recording medium 15.

In the driving method in the example shown in FIG. 1, the roll is driven (belt is driven with the rotation of the roll), but, the belt may be driven (roll is driven with the rotation of the belt).

Figure 2:
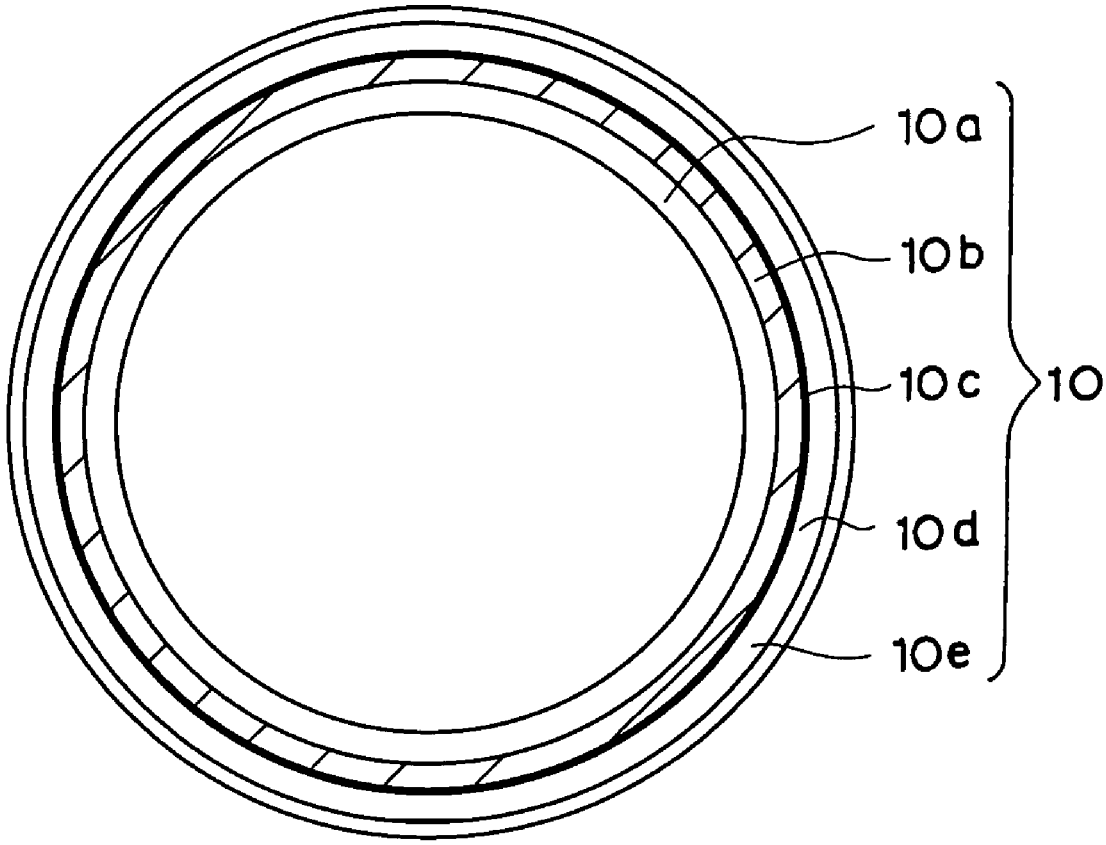
FIG. 2 is a schematic cross-sectional view showing a constituting example of a fixing member (fixing belt) of the invention.

As the fixing belt 10 which can be used in the fixing device as shown in FIG. 1, for example, a fixing belt having a constitution as shown in FIG. 2 can be utilized. FIG. 2 is a schematic cross-sectional drawing showing a constituting example of the fixing belt of the invention.

The fixing belt 10 as shown in FIG. 2 comprises a heating layer 10*b* formed of an electroconductive member which is brought to a self-heat by the electromagnetic induction action, a protective layer 10*c*, an elastic layer 10*d*, and a releasing layer 10*e* containing fluorine-based compound formed in this order on the outer peripheral surface of a heat resistant resin layer 10*a*.

Next, the heating principle of the heating layer 10*b* by the electromagnetic induction action will be explained below. First, when an alternate current passes in an electromagnetic induction coil 12*a* by the use of a magnetic excitation circuit (not shown), magnetic fluxes are repeatedly generated and disappeared around the electromagnetic induction coil 12*a*. When the magnetic flux traverses the heating layer 10*b* of the fixing belt 10, the eddy current is generated in the heating layer 10*b* so that a magnetic field is generated to hinder the variation in the magnetic fluxes. Joule heat is generated by the eddy current and the specific resistance of the heating layer 10*b*.

Almost all of the eddy current flows concentratedly on the surface at the side of the electromagnetic induction heating device 12 of the heating layer 10*b* due to the skin effect, and the heat is generated by the power proportional to a skin resistance Rs of the heating layer 10*b*. Here, when an angular frequency is ω, a magnetic permeability is μ, and a specific resistance is ρ, the depth of skin δ is represented by the following equation (A).

$$\delta=(2\rho/\omega\mu)^{1/2} \qquad \text{Equation (A)}$$

Furthermore, the skin resistance Rs is represented by the following equation (B).

$$Rs=\rho/\delta=(\omega\mu\rho/2)^{1/2} \qquad \text{Equation (B)}$$

When the current passes through the fixing belt 10 is Ih, the power P generated in the heating layer 10*b* of the fixing belt 10 is represented by the following equation (C).

$$P\propto Rs\int|Ih|2dS \qquad \text{Equation (C)}$$

Therefore, the power P can be increased and the generated heat quantity can be increased with increase in the skin resistance Rs or the current Ih. Here, the depth of skin δ (m) is represented by the following equation (D) using the frequency f (Hz) of the magnetic excitation circuit, the relative magnetic permeability μr, and the specific resistance ρ(Ω·m).

$$\delta=503(\rho/(f\mu r))^{1/2} \qquad \text{Equation (D)}$$

This equation indicates the absorption depth of the electromagnetic wave used in the electromagnetic induction, and the strength of the electromagnetic wave is 1/e or less at the point deeper than this depth. In other words, almost all of the energy is absorbed down to this depth.

Here, the thickness of the heating layer 10*b* is preferably larger than the skin depth represented by the above-described equation (preferably, in the range from 3 to 20 μm). Since if the thickness of the heating layer 16*b* is smaller than 3 μm, almost all of the electromagnetic energy cannot completely be absorbed, the efficiency may become low.

-Image Forming Device-

Next, an image forming device using the fixing device of the invention will be explained below. The image forming device of the invention is not particularly limited as long as the fixing device of the invention is used as a fixing device in known image forming devices utilizing an electrophotographic method, however, it is preferable that the image forming device has the following constitution.

Namely, an image forming device comprises an image carrier, a charging unit for charging the surface of the image carrier, a latent image forming unit for forming a latent image on the charged surface of the image carrier, a developing unit for developing the latent image with a developing agent to form a toner image, a transfer unit for transferring the toner image to an image receiving body and a fixing unit for heating and fixing the toner image onto a recording medium, wherein the fixing unit is the fixing device of the present invention. Further, the image forming device may comprise known other mechanisms or members, if necessary.

The image forming device of the invention, the heating property of the fixing belt is not deteriorated, even if the belt is used over a long period of time, so that a high image quality can stably obtained. Further, the image forming device consumes a low stand-by power which leads to be energy-saving. Hereinafter, the image forming device of the invention will be explained with reference to the drawings.

Figure 3:
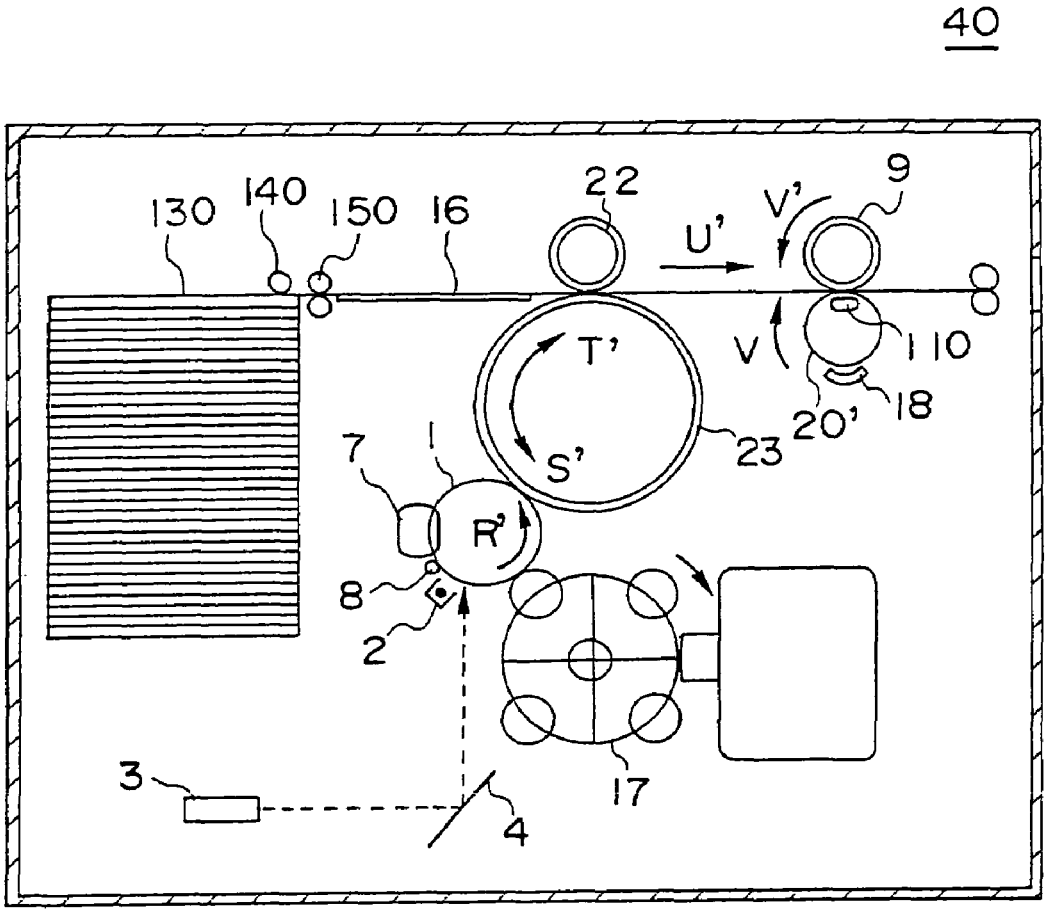
FIG. 3 is a schematic view showing an example of an image forming device of the invention.

In FIG. 3, the reference numeral 1 denotes a photoreceptor drum (image carrier body), the reference numeral 2 denotes an electrostatic charging device, the reference numeral 3 denotes a laser scanner (electrostatic latent forming device), the reference numeral 4 denotes a mirror, the reference numeral 7 denotes a cleaning device, the reference numeral 8 denotes a static eliminator, the reference numeral 9 denotes a pressing and fixing roll, the reference numeral 110 denotes a press pad, the reference numeral 130 denotes a paper feeding unit, the reference numeral 140 denotes a paper feeding roller, the reference numeral 150 denotes a register roller, the reference numeral 16 denotes a recording medium guide, the reference numeral 17 denotes rotary developing device (developing unit), the reference numeral 18 denotes an electromagnetic induction heating device, the reference numeral 20' denotes a endless belt (fixing belt), the reference numeral 22 denotes a transfer roll, the reference numeral 23 denotes an intermediate transfer body, and the reference numeral 40 denotes an image forming device.

In FIG. 3, in the arrow R' direction along the circumferential periphery of the photoreceptor drum sequentially are disposed, in the order of: the (non-contacting) electrostatic charging device 2 which is provided close to the photoreceptor drum 1 and electrostatically charges the surface of the drum, the rotary developing device 17 which forms a toner image by applying the toner to the latent image formed on the surface of the photoreceptor drum 1, the intermediate transfer body 23, the outer peripheral surface of which is brought into contact with the surface of the photoreceptor drum 1, capable of rotating in the both directions of the arrow S' and the arrow T', the cleaning device 7 which cleans the surface of the photoreceptor drum 1 after the toner image has been transferred to the surface of the intermediate transfer body 23 and the static eliminator 8 which statically eliminates the charges on the surface of the photoreceptor drum 1.

The surface of the photoreceptor drum 1 between the electrostatic charging device 2 and the developing device 17, is irradiated with a laser beam in accordance with respective color image information (signal) from the laser scanner 3 via the mirror 4 to form a latent image on the surface of the photoreceptor drum 1.

The developing device 17 has developing units (not shown) containing four colors of cyan, magenta, yellow, and black, and the toners of the respective colors are applied to the latent image formed on the surface of the photoreceptor drum 1 by the rotation of the developing device 17 to form a toner image.

In addition to the photoreceptor drum 1, the transfer roll 22 is provided on the periphery of the intermediate transfer body 23. The outer peripheral surface of the intermediate transfer body 23 is pressingly brought into contact the surface of the transfer roll 22, and the recording medium can be inserted through the press-contact section in the direction of the arrow U'. When the recording medium passes through the press-contact section, the toner image carried on the surface of the intermediate transfer body 23 is transferred to the surface of the recording medium. Moreover, the paper feeding device is provided in the direction opposite to the arrow U' direction with respect to the press-contact section, and the fixing device is provided in the direction of the arrow U'.

The paper feeding device includes a paper feeding unit 130, a paper feeding roller 140, a register roller 150 and a recording medium guide 16. The paper feed to the press-contact section between the intermediate transfer body 23 and the photoreceptor drum 1 is carried out in such a manner that the recording medium stored in the paper feeding unit 130 is raised up to the position where the paper is brought into contact with the paper feeding roller 140 by a recording medium raising up means (not shown) housed in the paper feeding unit 130, and at the time when the recording medium is brought into contact with the paper feeding roller 140, the record is conveyed in the direction of the arrow U' along the recording medium guide 16 by the rotation of the paper feeding roller 140 and the register roller 150.

Moreover, the fixing device comprises a pressing and fixing roll 9, a press pad 110, an electromagnetic induction heating device 18, and an endless belt (fixing belt) 20'. The pressing and fixing roll 9 is provided on the outer peripheral surface of the endless belt 20', such that a nip is formed in such a way that the pressing and fixing roll is brought into contact with the outer peripheral surface of the endless belt. In this case, the nip is formed such that the endless belt 20' is disposed at the intermediate transfer body 23 side in the direction of the arrow U' and the pressing and fixing roll 9 is disposed at the transfer roll 22 side.

The endless belt 20' and the pressing and fixing roll 9 are rotatable in association with each other in the directions of the arrow V and the arrow V', respectively. Further, the press pad 110 is provided on the inner peripheral surface of the endless belt 20' such that the press pad 110 faces and presses the surface of the pressing and fixing roll 9 to sandwich the endless belt 20' therebetween. Furthermore, an electromagnetic induction heating device 18 is disposed at approximately the opposite side to the pressing and fixing roll 9 so that the electromagnetic induction heating device 18 faces and is close to the outer peripheral surface of the endless belt 20.

Next, the transfer, and heating and fixation in the image forming device 40 will be explained below. First, the toner images having the respective colors formed on the surface of the photoreceptor drum 1 are transferred to be superposed with each other on the outer peripheral surface of the intermediate transfer body 23 so that each of the toner image having the respective colors corresponds with the image information on the press-contact section between the photoreceptor drum 1 and the intermediate transfer body 23 by applying a bias voltage between the photoreceptor drum 1 and the intermediate transfer body 23. In this way, the intermediate transfer body 23 on which the toner image of the colors has been transferred to the outer peripheral surface of the intermediate transfer body 23 rotates in the direction of the arrow T', and the toner image is transferred to the surface of the recording medium conveyed to the press-contact section by the paper feeding device.

The recording medium, on the surface of which the toner image has been transferred is conveyed in the direction of the arrow U', is heated and fixed to be fixed and fused, and the image is formed on the surface of the recording medium. The heating and fixing process has been described above, the outer peripheral surface of the endless belt 20' is heated by the electromagnetic induction heating device 18 provided opposite to the outer peripheral surface of the endless belt 20'. The heating process is the same as the process in connection to FIG. 3. The outer endless belt 20' having a sufficiently heated peripheral surface rotates in the direction of the arrow V, and the toner image of the surface of the recording medium which is inserted through the press-contacting section in the direction of the arrow U at the pressing and contacting section is heated and fixed to be heated and fuses by the pressing and fixing roll 9. In this way, the recording medium on the surface of which the color image has been formed is further conveyed in the direction of the arrow U, and discharged from the image forming device 40 to the outside.

EXAMPLES

Hereinafter, Examples of the invention will be explained below. However, methods for preparing a fixing belt of the invention used in the examples are not limited to the following examples.

Example A

Examples 1-3, Comparative Example 1

-Preparation of Fixing Belt-

An endless belt having a film thickness of 60 μm and an outer diameter of 30 mm is prepared using a polyimide resin (trade name: U varnish-S, manufactured by Ube Kosan, Co., Ltd.) As a material of heat resistant resin layer. Next, the outer peripheral surface of this endless belt is subjected to an alkali etching treatment and washing, and the outer peripheral surface of the belt is subjected to an electroless nickel plating to form a nickel layer having a thickness of 0.5 μm. Next, by using the electroless nickel plated layer as an electrode, a copper layer (inner peripheral side metal layer) having a layer thickness of 10 μm is formed on the nickel plated layer by an electroplating treatment. As the electroplating conditions, a plating liquid containing copper sulfate (70 g/L), sulfuric acid (200 g/L), and hydrochloric acid (50 mg/L), is used and the current density is made to 0.2 A/dm$^2$.

Thereafter, a nickel layer (outer peripheral side metal layer) having a layer thickness of 5 μm is formed on the copper layer by an electroplating treatment under the conditions by using the liquid composition as shown in Table 1. At this time, four samples having different internal stresses are prepared by changing the addition amount of the leveling agent as shown in the following Table 2. Furthermore, a fluorine resin (PFA) dispersion coating paint (trade name: EN-710CL, manufactured by Du Pont-Mitsui Fluorochemicals, Co., Ltd.) is coated on the nickel layer, and the coated samples are allowed to stand for one hour in a furnace at 380° C., to calcine the fluorine resin coated layer to form a PFA layer (releasing layer) having a thickness of 30 μm, so that a fixing member (fixing belt) is prepared. When the samples are prepared, the plating liquids are used as such, and the concentration of impure metal in the plating liquid is measured by QUALILAB QL-P (manufactured by ECI TECHNOLOGY, Co., Ltd.) which is a CVS (Cyclic Voltammetric Stripping Analysis) measurement device. As a result of this, the concentration of the impure metal in the plating liquid is 0.05% by weight.

TABLE 1

| Nickel electroplating liquid composition (amount of addition per 1 L) | |
|---|---|
| Nickel chloride | 45 g |
| Nickel sulfate | 250 g |
| Boric acid | 45 g |
| Leveling agent (Top Selina 95: Okuno Chemical Industries, Co., Ltd.) | 0-25 g |

Temperature: 50° C.
pH: 4.0
Current density: 3 A/dm$^2$

TABLE 2

| Relationship between amount of addition of leveling agent and internal stress | | | | |
|---|---|---|---|---|
| Amount of addition (g/L) | 0 | 10 | 15 | 25 |
| Internal stress (kg/mm$^2$) | 15 | 5 | 0 | −5 |

As shown in the above Table 2, it can be confirmed that the internal stress of the metal layer disposed at the outer peripheral side is changed by adjusting the amount of addition of leveling agent. Here, the internal stress is measured and determined by preparing test pieces made of stainless steel having a spiral shape having a thickness of 0.2 mm and a width of 20 mm and mounting the test pieces in a spiral deformeter (manufactured by YAMAMOTO-MS Co., Ltd.), and subjecting the test pieces to a plating treatment using the above-described plating liquid On the basis of the above-described information, a fixing belt having an internal stress of the metal layer disposed at the outer peripheral side is prepared by changing the amount of addition of the leveling agent as shown in the following Table 3 (Examples 1-3 and Comparative Example 1). The specific resistances of the metal layers of the outer peripheral side and inner peripheral side measured by LORESTA GP MCP-T600 type manufactured by Diainstruments, Co., Ltd. are 6.8 Ωm and 1.7 Ωm, respectively.

-Fixing Device-

Fixing devices are prepared by utilizing the respective fixing belts of Examples 1-3 and Comparative Example 1 in the following manner. Namely, an electromagnetic induction heating and fixing device equipped with the fixing belt, press roll, magnetic exciting coil (electromagnetic induction coil) and pressure applying member for press-contacting the fixing belt to the press roll is prepared. This fixing device will be explained below in detail.

The pressure applying member comprises an outer diameter section having substantially the same diameter as the inner diameter of the fixing belt, edge guides for regulating the movement in the axial direction of the fixing belt by being fitted into the both end sections of the fixing belt, a holder which has a smaller diameter than the inner diameter of the fixing belt and has a mounting section for mounting a pressing rubber pad, and the pressing rubber pad.

When this fixing device is assembled, the pressure applying member, the fixing belt and the press roll are disposed in the following way.

First, after the pressing rubber pad is fixed at the pad mounting section of the holder, and the pressure applying member has been inserted on the inner peripheral side of the fixing belt, then, the edge guide of the pressure applying member is mounted on both ends of the fixing belt. Subsequently, the nip is formed by making one portion of circumferential surface of the outer peripheral surface of the fixing belt on which the pressure applying member has been provided on the inner periphery in contact with the press roll, by loading between the axis of the press roll and the pressure applying member, and then, making the rubber pad of the pressure applying member and the press roll pressurizing and in contact with each other via the fixing belt. It should be noted that although it does not related with the present Example, the nip might be formed by utilizing pressurizing belts stretching over two pieces or more of shafts or rollers and making the belts pressurizing and in contact with the fixing belt.

As a material for constituting an edge guide and holder, a resin (PPS) which does not generate an induced electromotive force due to an alternate current and which has the heat resistance in the fixing temperature region is used.

Moreover, the magnetic exciting coil used in this fixing device is formed such that the gap between the magnetic exciting coil and the fixing belt is made uniform by utilizing a Litz cable composed of 16 copper wires having 0.5 mm in diameter insulated from each other being bundled and wound around the fixing belt wherein the length of the coil is longer than the width of the fixing belt to cover the width of about ⅙ to ¼ of the circumferential direction length of the fixing belt and the curvature of the coil is similar to the curvature of the fixing belt. The coil is mounted to the outer peripheral surface of the fixing belt so that the gap between the magnetic exciting coil and the fixing belt is made to 2 mm.

When fixation is conducted, a magnetic field is generated around the magnetic exciting coil by passing an alternate current to the magnetic exciting coil using the magnetic excitation circuit. Therefore, when the generated magnetic field transverses the heating layer of the fixing belt, san eddy current is generated such that the magnetic field in the direction of canceling the crossed magnetic field due to the electromagnetic induction is generated within the heating layer. For this reason, the heating according to the eddy current value and the resistance of the heating layer has is obtained.

The press roll is formed in such a manner that a foamed silicone rubber layer having a thickness of 12 mm as an elastic layer is provide on the solid shaft having an outer diameter of 16 mm, the silicone rubber layer is covered with a PFA tube having the film thickness of 30 μm.

More specifically, the press roll is prepared in the following way. First, a fluorine resin tube having an outer diameter of 50 mm, a length of 340 mm and a thickness of 30 μm, formed by coating an adhesive primer on the inner peripheral surface of the PFA tube and a solid shaft is set within a mold. Subsequently, after a liquid foamed silicone rubber is injected between the fluorine resin tube and the solid shaft so as to be the thickness of the layer of 2 mm, the press roll is prepared by vulcanizing and foaming the silicone rubber by subjecting to heating treatment (150° C.×2 hrs) to form an elastic layer.

This press roll is connected to a motor via a gear, and the fixing belt is driven by driving the press roll to transport a recording medium.

-Evaluation-

The evaluation of the fixing device is performed by the use of a modified machine in which the fixing device of DocuCentre Color 400 (manufactured by Fuji Xerox Co., Ltd.) is replaced with the above-described electromagnetic induction heating and fixing device of the invention, to carry out a paper feed test using 200,000 sheets of using the J paper manufactured by Fuji Xerox Co., Ltd. as paper.

As an evaluation item there is the change in a power factor, which is an electric property of the fixing belt, before and after the 200,000 sheet feed test. Herein, the power factor means the value of cos θ, where θ is the phase difference of the current and voltage within the magnetic exciting coil as a result of the eddy currents generated in the heating layer provided on the fixing belt when a high frequency current is allowed to pass through the magnetic exciting coil. The nearer the phase difference θ approaches to a value of 0, the higher the power factor becomes, and this is a condition under which the fixing belt can be more easily heated. The power factor is measured and evaluated by the following measurement and evaluation method.

<Power Factor>

In the fixing device shown in FIG. 1, the electromagnetic induction device 12 is replaced with an impedance meter WT1600FC manufactured by Yokogawa Electric Corporation, the power factor (cos θ) is calculated by measuring the phase difference θ of the current and voltage at the time when a high frequency current of 20 kHz is applied to the magnetic exciting coil. In the present invention, the power factor after the paper feed test is evaluated in terms of relative values when the power factor is made to 1.0 before the paper feed test. If the power factor is 0.9 or more, it can be said that there will not be problematic practically.

-Evaluation Results-

The paper feed test using 200,000 sheets in which the fixing belt obtained in Example 1 is used in this electromagnetic induction heating and fixing device is performed. The results of the power factor after the paper feed test when the power factor is 1 before the paper feed test are shown in Table 3 below.

TABLE 3

Power factor after feed test

| | Example 1 | Example 2 | Example 3 | Comparative Example 1 |
|---|---|---|---|---|
| Internal stress of protective layer ($kg/mm^2$) | −5 | −0.5 | 2 | 10 |
| Power factor after paper feed test | 0.90 | 1.00 | 1.00 | 0.60 |

The sample of Example 1 in which the internal stress of nickel layer is −5 $kg/mm^2$, the power factor is lowered by 10% as compared with the value before the paper feed test, however, the defects of the fixing member surface and the defects image quality are not observed. The sample of Example 2 in which the internal stress is −0.5 $kg/mm^2$ and the sample of Example 3 in which the internal stress is 2 $kg/mm^2$, the reduction in the power factor is not observed, the appearance of the fixing member and the image quality are not problematic at all. The sample of Comparative Example 1 in which the internal stress is 10 $kg/mm^2$, the defects are observed on the fixing member surface and the defects in the image quality are also observed in, and the durability of the fixing belt is problematic.

Examples 4-6, Comparative Example 2

Prior to the experiment, impure metal is further removed by subjecting a plating liquid for nickel electroplating to a plating operation at a current density of 0.5 $A/dm^2$ for 10 hours, and a fixing belt is prepared as shown in Table 4 in a similar manner as in Example 1. The concentration of impure metal in the nickel layer as a protective layer is measured by QUALILAB QL-P (manufactured by ECI TECHNOLOGY, Co., Ltd.) which is a CVS (Cyclic Voltammetric Stripping Analysis) measurement device by using the plating liquid for preparing the nickel layer as a sample. As a result, the concentration of the impure metal in the plating liquid is 0.05% by weight.

TABLE 4

| | Power factor after paper feed test | | | |
|---|---|---|---|---|
| | Example 4 | Example 5 | Example 6 | Comparative Example 2 |
| Internal stress of protective layer ($kg/mm^2$) | −5 | −0.5 | 2 | 10 |
| Power factor after paper feed test | 0.95 | 1.00 | 1.00 | 0.80 |

These power factors after the paper feed test are the same or higher as compared with Examples 1-3 when the comparison is carried out by using samples having the same internal stress of nickel layers, and it is confirmed that the impurities can further be removed. However, in the sample of the Comparative Example 2 having an internal stress of nickel layer of 10 $kg/mm^2$, defects on the fixing member surface, and defects in the image quality are observed, and the durability is also problematic.

Examples 7-9, Comparative Example 3

The fixing belt is prepared similar to Example 1 by setting the composition of the plating liquid and the plating conditions for forming protective layers as shown in Tables 5 and 6 below, and the plating operation is carried out working at a current density of 0.5 $A/dm^2$ for 10 hours, to remove impure metals.

TABLE 5

| Nickel electroplating liquid composition (amount of addition) | |
|---|---|
| Nickel sulfamate | 600 g/L |
| Nickel chloride | 5 g/L |
| Boric acid | 40 g/L |

Temperature: 60° C.
pH: 4.0
Current density: 6-30 $A/dm^2$

TABLE 6

| Relationship between current density and internal stress | | | | |
|---|---|---|---|---|
| Current density ($A/dm^2$) | 6 | 10 | 13 | 30 |
| Internal stress ($kg/mm^2$) | −10 | −5 | 0 | 10 |

From Table 6, it is confirmed that the internal stress can be controlled even by changing the current density. Then, fixing belts having internal stresses of the outer peripheral side metal layers as indicated in Table 7 below are prepared by changing the current density (Examples 7-9, and Comparative Example 3).

The paper feed tests using 200,000 sheets of the J paper manufactured by Fuji Xerox Co., Ltd. are performed in which electromagnetic induction heating fixing devices are prepared and the fixing device of DocuCentre Color400 (manufactured by Fuji Xerox Co., Ltd.) is replaced with the electromagnetic induction heating fixing devices, in a similar manner to Example 1, and the fixing devices are evaluated.

TABLE 7

| | Power factor after paper feed test | | | |
|---|---|---|---|---|
| | Example 7 | Example 8 | Example 9 | Comparative Example 3 |
| Internal stress of protective layer ($kg/mm^2$) | −4 | −1.5 | 0.5 | 10 |
| Power factor after paper feed test | 0.90 | 1.00 | 1.00 | 0.50 |

In the three samples (Examples 7-9) having the internal stress of nickel layer of 5 $kg/mm^2$ or less, the defects in the surface of the fixing members and the defects in the image quality are not observed. In the sample (Comparative Example 3) having the internal stress of nickel film is 10 $kg/mm^2$, the defects in surface of the fixing member and the defects in the image quality are observed, and the durability is problematic.

Example B

Examples 1-3, Comparative Example 1

-Preparation of Fixing Belt-

An endless belt having a film thickness of 60 μm and an outer diameter of 30 mm is prepared using a polyimide resin (trade name: U varnish-S, manufactured by Ube Kosan, Co., Ltd.) as a material of heat resistant resin layer. Next, the outer peripheral surface of this endless belt is subjected to an alkali etching treatment and washing, and the outer peripheral surface of the belt is subjected to an electroless nickel plating to form a nickel layer having a thickness of 0.5 μm. Next, by using the electroless nickel plated layer as an electrode, a copper layer (inner peripheral side metal layer) having a layer thickness of 10 μm is formed on the nickel plated layer by an electroplating treatment. The composition of the copper electroplating liquid is shown in Table 8 below.

Here, four samples having different internal stresses are prepared by adjusting the current density, and changing the kinds and addition amounts of leveling agents. At this time, the concentration of impure metal in the plating liquid measured by QUALILAB QL-P (manufactured by ECI TECHNOLOGY, Co., Ltd.) which is a CVS (Cyclic Voltammetric Stripping Analysis) measurement device is 0.05% by weight. Moreover, the internal stresses are measured by a spiral deformeter (manufactured by YAMAMOTO-MS Co., Ltd.).

TABLE 8

| Copper sulfate plating liquid composition (amount per 1 L) | |
|---|---|
| Copper sulfate | 70 g |
| Sulfuric acid | 200 g |
| Hydrochloric acid | 50 mg |

Thereafter, a nickel layer (outer peripheral side metal layer) having a layer thickness of 5 μm is formed on the copper layer by an electroplating treatment under the conditions by using the liquid composition as shown in Table 9. A silicone rubber layer having a thickness of 200 μm is coated on the nickel layer. Further, a fluorine resin (PFA) dispersion coating paint (trade name: EN-710CL, manufactured by Du Pont-Mitsui Fluorochemicals, Co., Ltd.) is coated on the nickel layer, and the coated sample is allowed to stand for one hour in a furnace at 380° C., to calcine the fluorine resin coated layer to form a PFA layer (releasing layer) having a thickness of 30 μm, so that a fixing member (fixing belt) is prepared. The specific resistances of the metal layers of the outer peripheral side and inner peripheral side measured by LORESTA GP MCP-T600 type manufactured by Diainstruments, Co., Ltd. are 6.8 Ωm and 1.7 Ωm, respectively.

TABLE 9

Copper plating conditions and internal stress

| | Current density ($A/dm^2$) | Leveling agent addition amount (per 1 L) | Internal stress ($kgf/mm^2$) |
|---|---|---|---|
| Example 1 | 1.5 | 0 | 2 |
| Example 2 | 10 | 5 | 3 |
| Example 3 | 10 | 10 | 2 |
| Comparative Example 1 | 10 | 0 | 6 |

-Fixing Device-

Fixing devices are prepared by utilizing the respective fixing belts of Examples 1-3 and Comparative Example 1 as described below. Namely, an electromagnetic induction heating and fixing device equipped with the fixing belt, press roll, magnetic exciting coil (electromagnetic induction coil) and pressure applying member for press-contacting the fixing belt to the press roll is prepared. This fixing device will be explained below in detail.

The pressure applying member comprises an outer diameter section having substantially the same diameter as the inner diameter of the fixing belt, edge guides for regulating the movement in the axial direction of the fixing belt by being fitted into the both end sections of the fixing belt, a holder which has a smaller diameter than the inner diameter of the fixing belt and has a mounting section for mounting a pressing rubber pad, and the pressing rubber pad.

When this fixing device is assembled, the pressure applying member, the fixing belt and the press roll are disposed in the following way.

First, after the pressing rubber pad is fixed at the pad mounting section of the holder, and the pressure applying member has been inserted on the inner peripheral side of the fixing belt, then, the edge guide of the pressure applying member is mounted on both ends of the fixing belt. Subsequently, the nip is formed by making one portion of circumferential surface of the outer peripheral surface of the fixing belt on which the pressure applying member has been provided on the inner periphery in contact with the press roll, by loading between the axis of the press roll and the pressure applying member, and then, making the rubber pad of the pressure applying member and the press roll pressurizing and in contact with each other via the fixing belt. It should be noted that although it does not related with the present Example, the nip might be formed by utilizing pressurizing belts stretching over two pieces or more of shafts or rollers and making the belts pressurizing and in contact with the fixing belt.

As a material for constituting an edge guide and holder, a resin (PPS) which does not generate an induced electromotive force due to an alternate current and which has the heat resistance in the fixing temperature region is used.

Moreover, the magnetic exciting coil used in this fixing device is formed such that the gap between the magnetic exciting coil and the fixing belt is made uniform by utilizing a Litz cable composed of 16 copper wires having 0.5 mm in diameter insulated from each other being bundled and wound around the fixing belt wherein the length of the coil is longer than the width of the fixing belt to cover the width of about ⅙ to ¼ of the circumferential direction length of the fixing belt and the curvature of the coil is similar to the curvature of the fixing belt. The coil is mounted to the outer peripheral surface of the fixing belt so that the gap between the magnetic exciting coil and the fixing belt is made to 2 mm. When fixation is conducted, a magnetic field is generated around the magnetic exciting coil by passing an alternate current to the magnetic exciting coil using the magnetic excitation circuit. Therefore, when the generated magnetic field transverses the heating layer of the fixing belt, san eddy current is generated such that the magnetic field in the direction of canceling the crossed magnetic field due to the electromagnetic induction is generated within the heating layer. For this reason, the heating according to the eddy current value and the resistance of the heating layer has is obtained.

The press roll is formed in such a manner that a foamed silicone rubber layer having a thickness of 12 mm as an elastic layer is provide on the solid shaft having an outer diameter of 16 mm, the silicone rubber layer is covered with a PFA tube having the film thickness of 30 μm.

More specifically, the press roll is prepared in the following way. First, a fluorine resin tube having an outer diameter of 50 mm, a length of 340 mm and a thickness of 30 μm, formed by coating an adhesive primer on the inner peripheral surface of the PFA tube and a solid shaft is set within a mold. Subsequently, after a liquid foamed silicone rubber is injected between the fluorine resin tube and the solid shaft so as to be the thickness of the layer of 2 mm, the press roll is prepared by vulcanizing and foaming the silicone rubber by subjecting to heating treatment (150° C.×2 hrs) to form an elastic layer.

This press roll is connected to a motor via a gear, and the fixing belt is driven by driving the press roll to transport a recording medium.

-Evaluation-

The evaluation of the fixing device is performed by the use of a modified machine in which the fixing device of DocuCentre Color 400 (manufactured by Fuji Xerox Co., Ltd.) is replaced with the above-described electromagnetic induction heating and fixing device of the invention, to carry out a paper feed test using 200,000 sheets of using the J paper manufactured by Fuji Xerox Co., Ltd. as paper.

As an evaluation item, the change in a power factor which is an electric property of the fixing belt before and after the 200,000 sheet feed test. Herein, the power factor means the value of cos θ measured at the time when the phase difference θ of the current and voltage applied to the magnetic exciting coil due to the eddy current generated in the heating layer provided on the fixing belt when a high frequency current is allowed to pass the magnetic exciting coil. The nearer the phase difference θ approaches to a value of 0, the higher the power factor becomes, and is more easily heated. The power factor is measured and evaluated by the following measurement and evaluation method.

<Power Factor>

In the fixing device shown in FIG. 1, the electromagnetic induction device 12 is replaced with an impedance meter WT1600FC manufactured by Yokogawa Electric Corporation, the power factor (cos θ) is calculated by measuring the phase difference θ of the current and voltage at the time when a high frequency current of 20 kHz is applied to the magnetic exciting coil. In the present invention, the power factor after the paper feed test is evaluated in terms of relative values when the power factor is made to 1.0 before the paper feed test. If the power factor is 0.9 or more, it can be said that there will not be problematic practically.

-Evaluation Results-

The paper feed test using 200,000 sheets in which the fixing belt obtained in Example 1 is used in this electromagnetic induction heating and fixing device is performed. The results of the power factor after the paper feed test when the power factor is 1 before the paper feed test are shown in Table 10 below.

TABLE 10

| Power factor after paper feed test | |
|---|---|
| Example 1 | 0.96 |
| Example 2 | 0.98 |
| Example 3 | 1 |
| Comparative Example | 0.87 |

In the sample having an internal stress of the heating layer of 6 kgf/mm$^2$ in Comparative Example 1, the power factor after the paper feed test is lowered by 30% as compared with that before the paper feed test, and defects in the image quality are observed. The reduction of the power factor of the samples of Examples 1-3, is small and the defects in the image quality are not observed.

According to the present invention, a fixing member that the warming-up time is short and the deterioration of durability is suppressed, a fixing device using the fixing member and an image forming device using the fixing device can be obtained.

What is claimed is:

1. A fixing member comprising a heat-resistant resin layer, two or more metal layers, and a releasing layer, in this order from an inner peripheral side, wherein a specific resistance of the metal layer disposed nearest an outer peripheral side is larger than a specific resistance of the metal layer disposed nearest the inner peripheral side in the two or more metal layers, and a modulus of an internal stress of the metal layer nearest the outer peripheral side is 5 kg/mm$^2$ or less.

2. A fixing member according to claim 1, wherein a concentration of impure metal contained in the metal layer disposed nearest the outer peripheral side is 0.1% by weight or less.

3. A fixing member according to claim 1, wherein the metal layer disposed nearest the inner peripheral side contains copper as a main component and the metal layer disposed nearest the outer peripheral side contains nickel as a main component.

4. A fixing member according to claim 1, wherein the metal layer disposed nearest the inner peripheral side and the metal layer disposed nearest the outer peripheral side are formed by electroplating.

5. A fixing member according to claim 1, wherein the metal layer disposed nearest the outer peripheral side contains nickel as a main component, and the metal layer disposed nearest the outer peripheral side is formed by electroplating, by use use of a Watt bath into which a sulfur-containing organic compound is added.

6. A fixing member according to claim 1, wherein the heat-resistant resin has a polyimide as a main component.

7. A fixing member according to claim 1, wherein the releasing layer has a fluorine resin as a main component.

8. A fixing member according to claim 1, wherein the fixing member has an elastic layer between the metal layers and the releasing layer.

9. A fixing member according to claim 1, wherein the fixing member is an endless belt.

10. A fixing member according to claim 1, wherein the metal layers are heated by an electromagnetic induction device.

11. A fixing member comprising a heat resistant resin layer, two or more metal layers, and a releasing layer, in this order from an inner peripheral side, wherein a specific resistance of the metal layer disposed nearest an outer peripheral side is larger than a specific resistance of metal layer disposed nearest the inner peripheral side in the two or more metal layers, and a modulus of an internal stress of the metal layer disposed nearest the inner peripheral side is 5 kg/mm$^2$ or less.

12. A fixing member according to claim 11, wherein the modulus of the internal stress of the metal layer disposed nearest the outer peripheral side is 5 kg/mm$^2$ or less.

13. A fixing member according to claim 11, wherein the modulus of the internal stress of a totality of the two or more metal layers laminated on the heat resistant resin layer is 5 kg/mm$^2$ or less.

14. A fixing member according to claim 11, wherein a concentration of impure metal contained in the metal layer disposed nearest the inner peripheral side is 0.1% by weight or less.

15. A fixing member according to claim 11, wherein the metal layer disposed nearest the inner peripheral side contains at least any one of gold, silver or copper as the main component(s).

16. A fixing device comprising:

a fixing member having a heat resistant resin layer, two or more metal layers, and a releasing layer, in this order from an inner peripheral side, wherein a specific resistance of the metal layer disposed nearest an outer peripheral side is larger than a specific resistance of the metal layer disposed nearest the inner peripheral side in the two or more metal layers, and a modulus of an internal stress of the metal layer disposed nearest the outer peripheral side is 5 kg/mm$^2$ or less;

an electromagnetic induction heating device for applying a magnetic field to the fixing member;

and a press member which comes into contact with a surface of the releasing layer of the fixing member.

17. An image forming device comprising an image carrier, a charging unit for charging a surface of the image carrier, a latent image forming unit for forming a latent image on the charged surface of the image carrier, a developing unit for developing the latent image with a developing agent to form a toner image, a transfer unit for transferring the toner image to an image receiving body and a fixing unit for heating and fixing the toner image onto a recording medium, wherein the fixing unit is the fixing device of claim 16.

18. A fixing device comprising:

a fixing member comprising a heat resistant resin layer, two or more metal layers, and a releasing layer, in this order from an inner peripheral side, wherein a specific resistance of the metal layer disposed nearest an outer peripheral side is larger than a specific resistance of the metal layer disposed nearest the inner peripheral side in the two or more metal layers, and a modulus of an internal stress of the metal layer disposed nearest the inner peripheral side is 5 kg/mm$^2$ or less;

an electromagnetic induction heating device for applying a magnetic field to the fixing member; and a press member which comes into contact with a surface of the releasing layer of the fixing member.

19. An image forming device comprising an image carrier, a charging unit for charging a surface of the image carrier, a latent image forming unit for forming a latent image on the charged surface of the image carrier, a developing unit for developing the latent image with a developing agent to form a toner image, a transfer unit for transferring the toner image to an image receiving body and a fixing unit for heating and fixing the toner image onto a recording medium, wherein the fixing unit is the fixing device of claim 17.

* * * * *